US007172443B1

(12) United States Patent
Ju

(10) Patent No.: US 7,172,443 B1
(45) Date of Patent: Feb. 6, 2007

(54) ELECTRICAL CONNECTOR SET

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/399,375

(22) Filed: Apr. 7, 2006

(51) Int. Cl.
*H01R 13/62* (2006.01)

(52) U.S. Cl. ..... 439/159; 439/594; 439/717

(58) Field of Classification Search ..... 439/64, 439/159, 945, 377, 630, 594, 541.5, 717
See application file for complete search history.

(56) References Cited

U.S. PATENT DOCUMENTS 3,932,016 A * 1/1976 Ammenheuser ..... 439/377
5,216,578 A * 6/1993 Zenitani et al. ..... 361/690
6,059,610 A * 5/2000 Chu ..... 439/631
6,099,323 A * 8/2000 Ho et al. ..... 439/64
6,275,389 B1 * 8/2001 Huang et al. ..... 361/807
6,527,568 B2 * 3/2003 Nakamura ..... 439/159
6,648,680 B1 * 11/2003 Hu ..... 439/541.5

* cited by examiner

*Primary Examiner*—Tho D. Ta
(74) *Attorney, Agent, or Firm*—Troxell Law Office, PLLC

(57) ABSTRACT

An electrical connector set is disclosed to include an electrical connector, which has an electrically insulative housing houses a plurality of metal contact pins, the electrically insulative housing having a dovetail groove at each of two distal ends thereof, and two guide rails respectively connected to the two distal ends of the electrically insulative housing at right angles for guiding an electronic device into connection with the electrical connector, each guide rail having a long arm and a short arm connected to one end of the long arm at right angles, the short arm having a dovetail block extending from one end thereof remote from the long arm and fastened to the retaining groove at one end of the electrically insulative housing.

9 Claims, 4 Drawing Sheets

ELECTRICAL CONNECTOR SET

BACKGROUND OF THE INVENTION

1. Field of the Invention

The present invention relates to an electrical connector and more particularly, to an electrical connector set, which is easy to install and requires less installation space.

2. Description of the Related Art

Following fast development of electronic technology, advanced electronic devices are created having light, thin, short, small characteristics and the convenience of high mobility. Further, different electronic cards for different purposes are developed for use with mobile electronic devices. Electronic connectors are used as connection medium between electronic devices and electronic cards. In order to fit the small characteristic of advanced electronic devices, electric connectors must be made requiring less installation space.

A conventional electronic card connector is known comprising a connector body, an electrically insulative bracket, a shielding shell, and a plurality of mounting devices. During installation, the electrically insulative bracket is horizontally inserted into the gap between the connector body and the shielding shell. However, if the circuit board already has other electronic component parts of different heights mounted thereon, a big horizontal space must be left above the circuit board beyond the electronic component parts for the mounting of the aforesaid electronic card connector.

SUMMARY OF THE INVENTION

The present invention has been accomplished under the circumstances in view. It is one object of the present invention to provide an electrical connector set, which is easy to install and requires less installation space. It is another object of the present invention to provide an electrical connector set, which allows access of guide rails to the electrical connector in vertical direction during installation. To achieve these and other objects of the present invention, the electrical connector set comprises an electrical connector, the electrical connector comprising an electrically insulative housing and at least one metal contact pin respectively mounted in the electrically insulative housing, the electrically insulative housing having a retaining groove at each of two distal ends thereof; and two guide rails respectively connected to the two distal ends of the electrically insulative housing for guiding an electronic device into connection with the electrical connector, the guide rails each having a long arm and a short arm connected to one end of the long arm at right angles, the short arm having a retaining block extending from one end thereof remote from the long arm and fastened to the retaining groove at one end of the electrically insulative housing.

DETAILED DESCRIPTION OF THE PREFERRED EMBODIMENT

Figure 1:
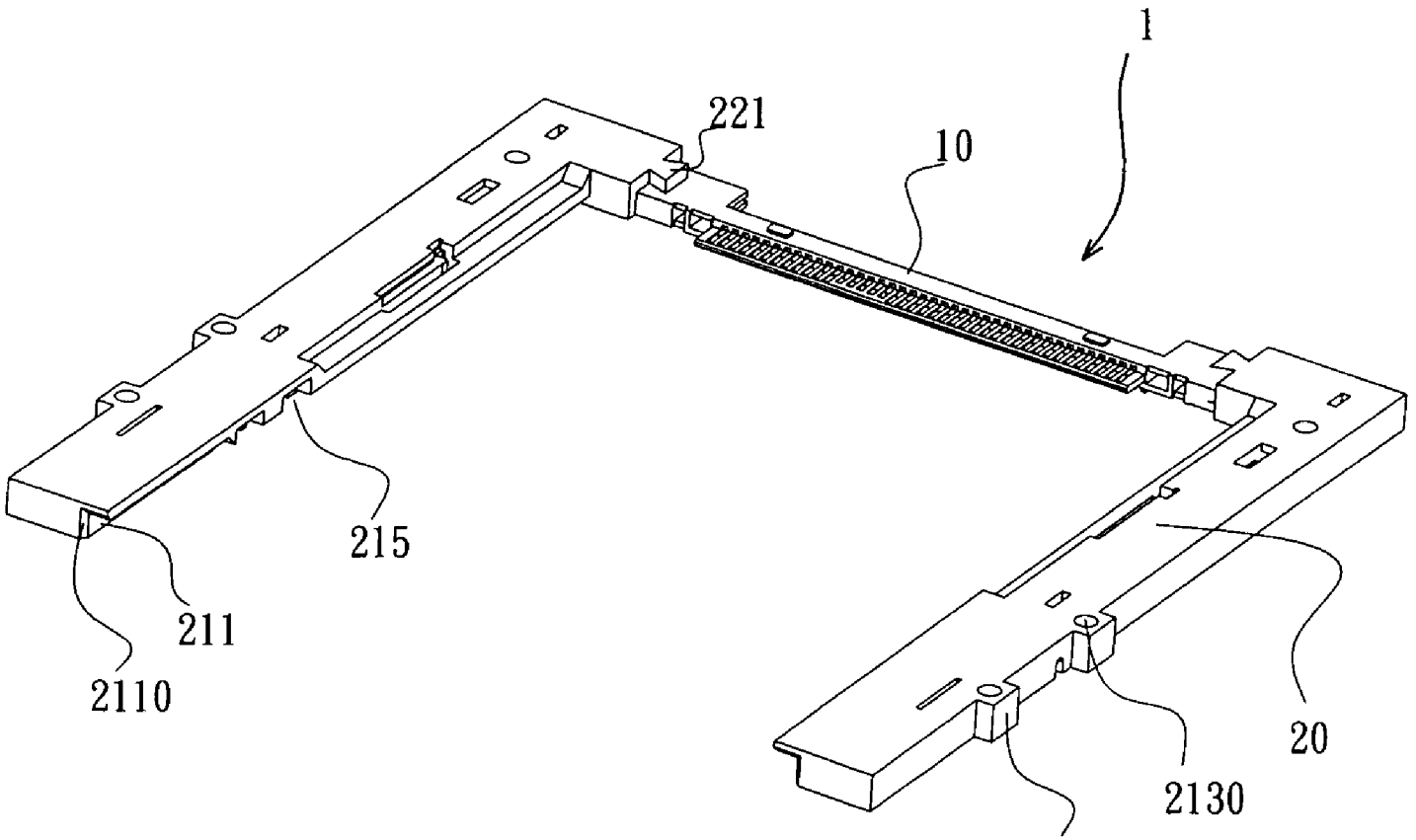
FIG. 1 is an oblique top elevation of an electrical connector set in accordance with the present invention.
Figure 2:
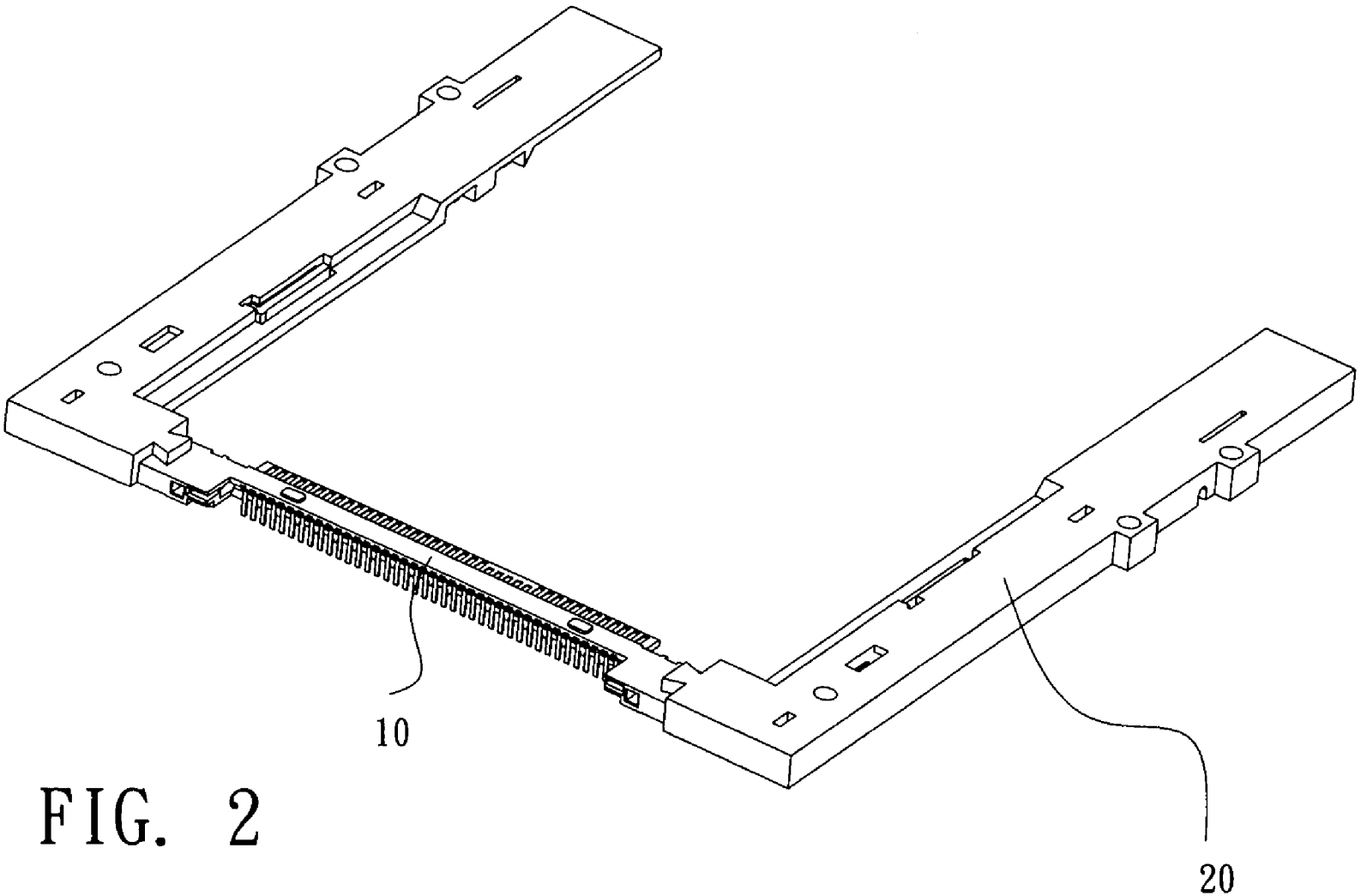
FIG. 2 is an oblique bottom elevation of the electrical connector set according to the present invention.
Figure 3:
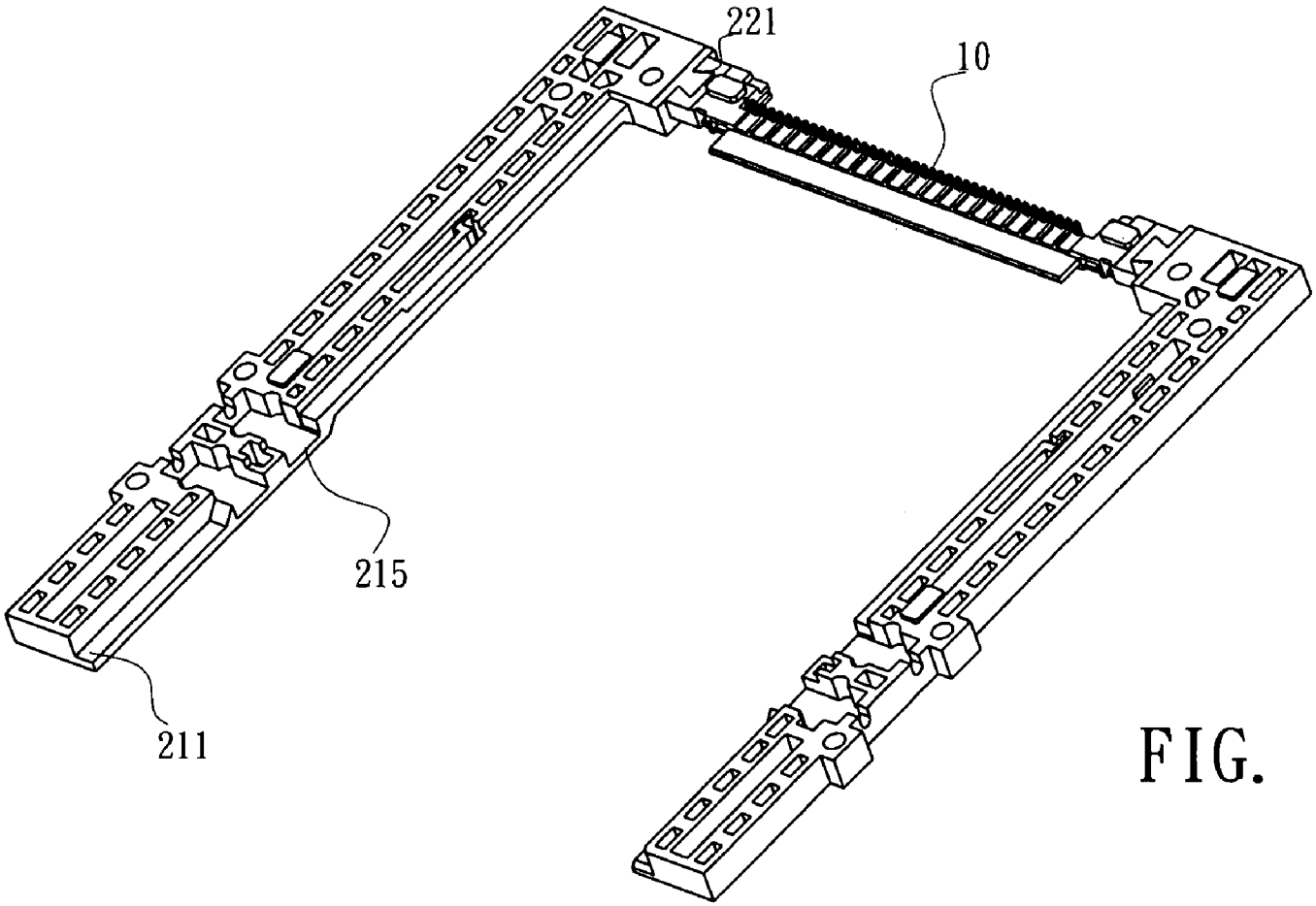
FIG. 3 is sectional elevation of the electrical connector set according to the present invention.
Figure 4:
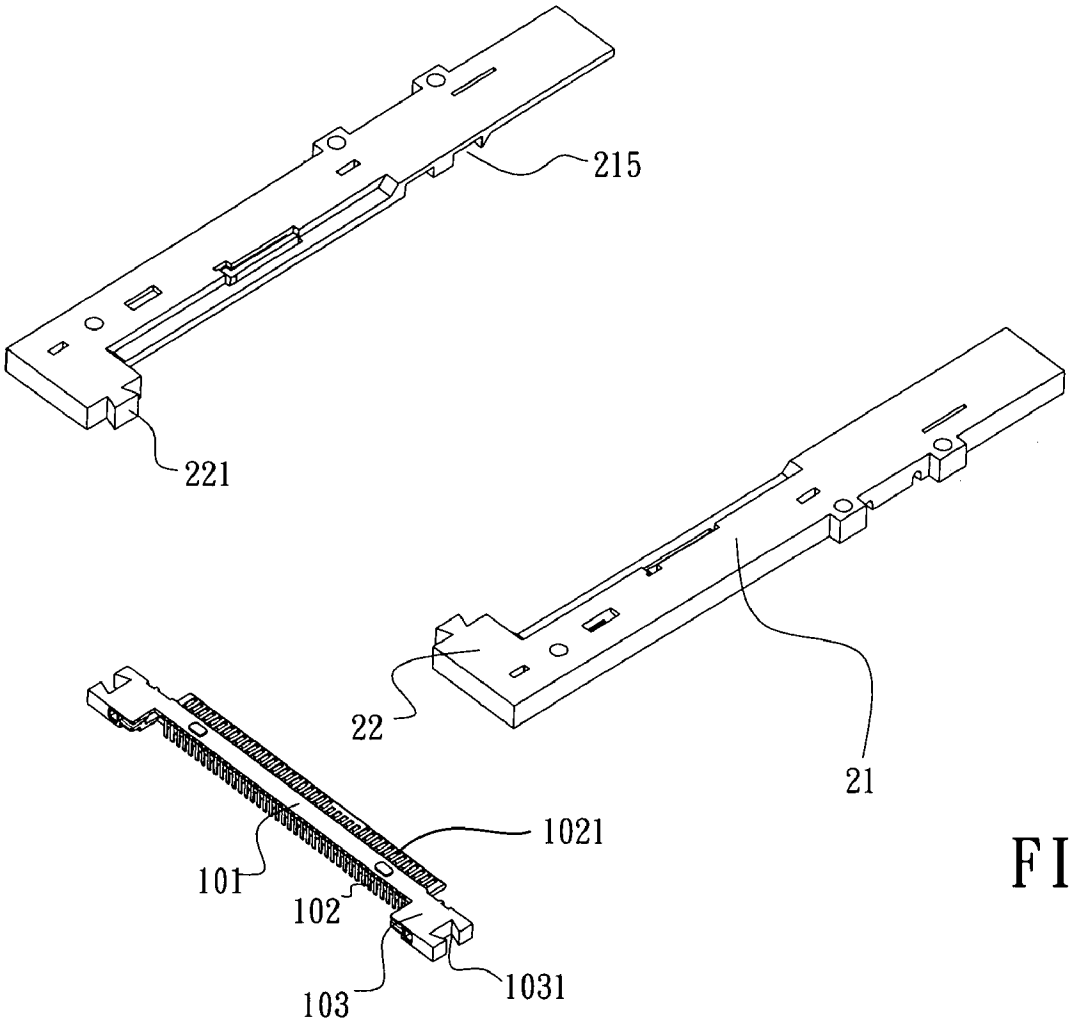
FIG. 4 is an exploded view of the electrical connector set according to the present invention.

Referring to FIGS. 1~4, an electrical connector set in accordance with the present invention is shown comprised of an electrical connector 10 and two guide rails 20.

The electrical connector 10 comprises an electrically insulative housing 101 and a plurality of metal contact pins 102. The electrically insulative housing 101 has a plurality of terminal slots 1012, which accommodates the metal contact pins 102 respectively, two mounting flanges 103 respectively disposed at the two distal ends thereof. Each mounting flange 103 has a retaining groove, for example, a dovetail groove 1031 cut through the top and bottom sides thereof.

Each guide rail 20 comprises a long arm 21 and a short arm 22 connected at right angles. The short arm 22 has one end formed integral with one end of the long arm 21 and the other end terminating in a retaining block, for example, dovetail block 221 for engagement into the dovetail groove 1031 of one mounting flange 103. The long arm 21 has a longitudinal sliding groove 211 extending along the length at one lateral side, namely, the inner lateral side for receiving a first electronic device (not shown), and two chamfered guide edges 2110 disposed at two sides of one end of the longitudinal sliding groove 211 remote from the short arm 22 for guiding the first electronic device into the longitudinal sliding groove 211 (alternatively, three chamfered guide edges may be formed on one end of the longitudinal sliding groove remote from the short arm at different angles).

The long arm 21 further has two mounting blocks 213 protruded from the outer lateral side thereof opposite to the longitudinal sliding groove 211. Each mounting block 213 has a mounting through hole 2130 for the mounting of a respective screw or fastening member to affix the respective guide rail 20 to a circuit board (not shown). The long arm 21 further has two receiving holes 215 on the bottom side on the middle for the mounting of a second electronic device (not shown).

During installation, the electrical connector 10 is mounted on the circuit board (not shown), and then the two guide rails 20 are connected to the two distal ends of the electrical connector 10 by forcing the respective dovetail blocks 221 into engagement with the respective dovetail grooves 1031, and then screws (or other fastening members) are mounted in the mounting through holes 2130 of the mounting blocks 213 to affix the guide rails 20 to the circuit board.

According to the aforesaid design, the guide rails 20 can be fastened to the electrical connector 10 vertically from the top side after installation of the electrical connector 10 in the circuit board. Therefore, this installation design requires less circuit board mounting space.

A prototype of electrical connector set has been constructed with the features of FIGS. 1~4. The electrical connector set functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. An electrical connector set comprising:

an electrical connector, said electrical connector comprising an electrically insulative housing and at least one metal contact pin respectively mounted in said electrically insulative housing, said electrically insulative housing having a retaining groove at each of two distal ends thereof; and two guide rails respectively connected to the two distal ends of said electrically insulative housing for guiding an electronic device into connection with said electrical connector, said guide rails each having a long arm and a short arm connected to one end of said long arm at right angles, said short arm having a retaining block extending from one end thereof remote from said long arm and fastened to the retaining groove at one end of said electrically insulative housing, wherein said guide rails each have a longitudinal sliding groove longitudinally extending along the respective long arm at an inner side for guiding an electronic device into connection with said electrical connector, wherein the longitudinal sliding groove is downward facing.

2. The electrical connector set as claimed in claim 1, wherein said retaining groove cuts through top and bottom sides of said electrically insulative housing.

3. The electrical connector set as claimed in claim 1, wherein said retaining groove is a dovetail groove; said retaining block is a dovetail block.

4. The electrical connector set as claimed in claim 1, wherein said electrically insulative housing comprises at least one terminal slot adapted to accommodate said at least one metal contact pin respectively.

5. The electrical connector set as claimed in claim 1, wherein said guide rails each have a plurality of mounting blocks disposed at an outer side for mounting.

6. The electrical connector set as claimed in claim 5, wherein said mounting blocks each have a mounting through hole for fastening to a circuit board with a respective fastening member.

7. The electrical connector set as claimed in claim 1, wherein said guide rails each have three chamfered guide edges disposed at one end of the respective longitudinal sliding groove at different sides remote from said electrical connector for guiding an electronic device into the respective longitudinal sliding groove.

8. The electrical connector set as claimed in claim 1, wherein said guide rails each have two chamfered guide edges disposed at one end of the respective longitudinal sliding groove at two adjacent sides remote from said electrical connector for guiding an electronic device into the respective longitudinal sliding groove.

9. The electrical connector set as claimed in claim 1, wherein said guide rails each have at least one receiving hole for the mounting of a second electronic device.

* * * * *